United States Patent [19]

Ito et al.

[11] 3,951,542

[45] Apr. 20, 1976

[54] DEVELOPER CONVEYOR DEVICE

[75] Inventors: Yoshio Ito, Yokohama; Toru Takahashi, Tokyo; Tadayuki Kitajima; Syujiro Kadowaki, both of Yokohama, all of Japan

[73] Assignee: Canon Kabushiki Kaisha, Tokyo, Japan

[22] Filed: May 7, 1974

[21] Appl. No.: 467,744

[30] Foreign Application Priority Data

May 14, 1973 Japan ..... 48-53279

[52] U.S. Cl. ..... 355/15; 118/637; 355/3 DD

[51] Int. Cl.[2] ..... G03G 21/00

[58] Field of Search ..... 355/3 DD, 15, 3 DR; 118/637, 312

[56] References Cited

UNITED STATES PATENTS

| | | | |
|---|---|---|---|
| 3,700,328 | 10/1972 | Davidge et al. | 355/3 DD |
| 3,752,576 | 8/1973 | Gerbasi | 355/3 DD |

OTHER PUBLICATIONS

"Flexible Auger Toner Transport", C. A. Queener, IBM Tech. Bull., Vol. 15, No. 4, Sept. 1972, p. 1262.

"Toner Reclaiming System ," F. W. Johnson et al., IBM Tech. Bull., Vol. 14, No. 1, June 1971, p. 235.

*Primary Examiner*—R. L. Moses

*Attorney, Agent, or Firm*—Fitzpatrick, Cella, Harper & Scinto

[57] ABSTRACT

A developer conveyor device comprises a rotatable photosensitive medium, a developer conveyor member disposed outwardly of the effective width of the photosensitive medium, cleaning means for removing residual developer on the surface of the photosensitive medium, primary conveyor means for guiding the developer removed by the cleaning means to the developer conveyor member, and secondary conveyor means for further guiding the developer from the primary conveyor means into a developer containing portion.

20 Claims, 8 Drawing Figures

DEVELOPER CONVEYOR DEVICE

BACKGROUND OF THE INVENTION

1. Field of the Invention

This invention generally relates to a developer conveyor device applicable in electrophotographic copying machines of the image transfer type. More specifically, it relates to a developer conveyor device for positively conveying the developer to a developer receptacle portion or a developing portion when the residual developer remaining on the surface of an electrophotographic photosensitive medium has been removed therefrom for reuse after an electrostatic latent image formed on the photosensitive medium has been dry -or wet-developed and transferred to a transfer medium.

2. Description of the Prior Art

Generally in electrophotographic copying machines, an electrostatic latent image may be formed on an electrophotographic photosensitive medium by an electrophotographic method as disclosed in U.S. Pat. No. 2,221,776 wherein the surface of a photosensitive medium comprising a photoconductive layer superposed on a conductive back-up member is uniformly charged and then subjected to application of image light to form an electrostatic latent image, or an electrophotographic method as disclosed in U.S. Pat. No. 3,438,706 wherein the surface of a photosensitive medium having a chargeable dielectric layer on a photoconductive layer is uniformly charged and then subjected to simultaneous application of image light and charge of the opposite polarity or AC corona discharge to form an electrostatic latent image in accordance with the light-and-dark pattern of the original image, whereafter, if required, the surface of the photosensitive medium may be subjected to an overall exposure to thereby form an electrostatic latent image of high contrast, or any one of other various electrophotographic methods. The latent image so formed may be visualized by means of dry or wet developer and the visualized image may be transferred to a transfer medium such as ordinary paper or the like, whereafter the transferred image may be fixed by heat or the like. The surface of the photosensitive medium may be cleaned by cleaning means for repetitive use. Thus, in the copying machines of the image transfer type, cleaning of the photosensitive medium to remove the residual developer therefrom is an essential requisite and the developer so removed is collected from the cleaning station to a predetermined portion of the machine by attraction or by mechanical conveyor means, whereafter the collected developer is discarded or treated. As a copying machine accelerates its copying speed, the amount of the developer collected in a container is increased and must be discarded before the collected amount reaches the maximum capacity of the container. This has been greatly inconvenient in use. In such cases, therefore, it would be positively considered to guide the removed developer into developing means for reuse.

Means for conveying such developer to the developer receptacle or the developing portion may be a belt conveyor system, but this would offer numerous disadvantages such as complication of the apparatus, unstability of the conveyance, etc. An alternative may be a system whereby a ball-like chain belt is moved around in a tube, but such system would fail to smoothly convey fine toner particles and in addition, the toner itself would be subjected to extraneous pressure which would cause coagulation between toner particles, which in turn would lead to the necessity for the toner to be re-dispersed within the developing means, thus resulting in reduced quality of the copy image. Moreover, the toner to be collected and conveyed is in the form of very fine particles which are so poor in fluidity that the conveyance of the toner to the developing portion for reuse would be very difficult with such system. Also, this system could not practically be used with liquid developer. Thus, there has theretofore been proposed no stable system.

SUMMARY OF THE INVENTION

It is a primary object of the present invention to provide an improved developer conveyor device which enables the developer removed from the surface of a photosensitive medium during cleaning to be stably conveyed by a very simple construction.

It is another object of the present invention to provide an improved developer conveyor device which performs the conveyance of the developer without any unnecessary extraneous pressure being imparted to the developer.

According to the present invention, a conveying area is provided in the non-image-bearing portion of a photosensitive medium, and the rotation of such conveying area from a cleaning station to a developing station occurring with the rotation of the photosensitive medium is effectively utilized to effect stable and positive conveyance of the removed developer without any extraneous pressure imparted thereto. If required, the device may be constructed so as to prevent the interior of the copying machine from being contaminated by scattered toner particles, and also may be designed quite independently of the other process means necessary for the copying processes such as developing, application of image light, charging, etc. surrounding the photosensitive medium, such that the conveyor device does not interfere with any of these process means.

Other objects and features of the present invention will become fully apparent from the following detailed description of some embodiments taken in conjunction with the accompanying drawings.

DESCRIPTION OF THE PREFERRED EMBODIMENTS

Figure 1:
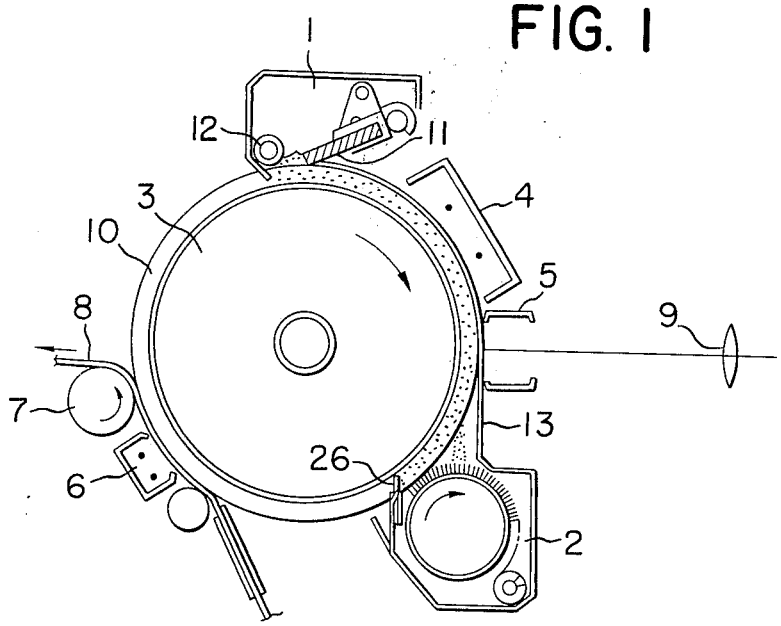
FIG. 1 is a vertical cross-section of an embodiment of the present invention.
Figure 2:
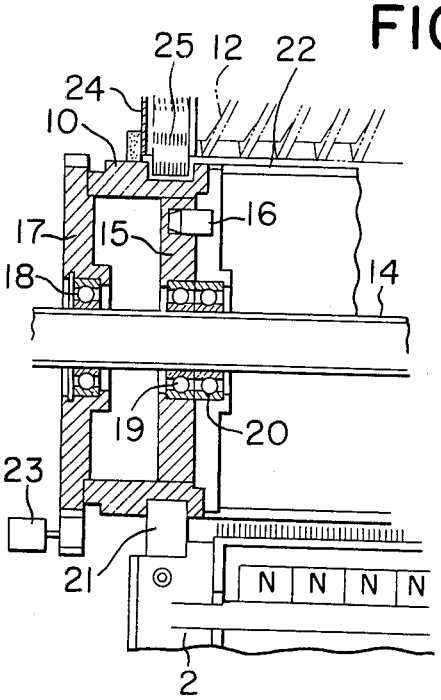
FIG. 2 is a longitudinal section of the same embodiment.
Figure 3:
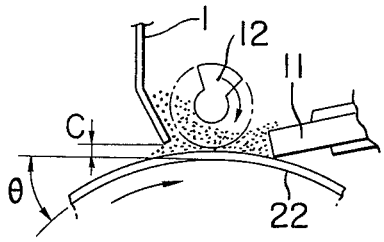
FIG. 3 is an enlarged detail showing the neighborhood of the cleaning means in the same embodiment.
Figure 4:
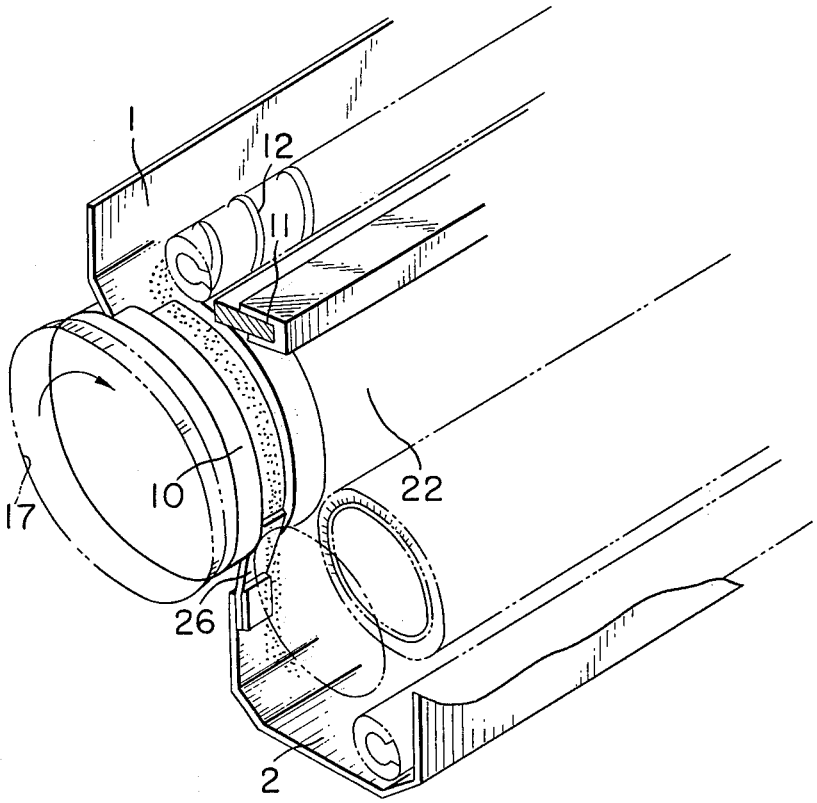
FIG. 4 is a fragmentary perspective view of the same embodiment.

FIG. 1 is a cross-section of an embodiment of the present invention showing a copying process in a copying machine. An optical image to be formed on the peripheral surface of a rotating drum-shaped photosensitive medium through charger means 4 and lens 9 is passed through a slit 5 for projection upon the surface of the photosensitive drum. The latent image thus formed on the photosensitive drum is visualized by developing means 2, and then the powder image on the rotating drum 3 is transferred to a sheet of transfer paper 8 advancing in synchronism with the powder image, with the aid of corona charger means 6, whereafter the transfer paper is delivered to a fixing device, not shown. Residual toner remains on the surface of the photosensitive drum after the powder image has been transferred therefrom to the transfer paper 8, but the surface of the photosensitive drum is cleaned by a cleaning blade 11 in contact with the photosensitive medium to collect the residual toner into a cleaning container 1. After the cleaning has been done, the collected toner is rotatively conveyed by primary conveyor means such as screw roller 12 (which may be rigid, or elastic with respect to liquid developer), so as to advance in parallelism to the surface of the photosensitive medium and toward one end edge thereof which is on this side as viewed in the drawing. The toner thus directed outwardly of the widthwise range of the photosensitive medium reaches the wall of the cleaning device, which forces the toner to change its direction of travel. If a rotating multivane member or a rotating brush or the like were provided in the neighborhood, the toner would undergo an action of being forced out in the centrifugal direction. FIG. 2 shows how smoothly the toner may be directed into the developing means without falling off. A gear 17 rotatable on a bearing 18 mounted on a stationary shaft 14 at a predetermined location thereof may be rotated by a drive motor 23, and a grooved rotatable member 10 is connected to the gear 17 and rotatable on another bearing 19 with the gear 17. The photosensitive drum, designated herein by 22, is rotatable on a further bearing 20 and operatively coupled to the rotatable member 10 by a connector pin 16, and is mounted in contact with the rotatable member 10. In accordance with this construction, the grooved rotatable member is rotatable together with the photosensitive drum, but in some cases it will also be effective either to design the grooved rotatable member for relative rotation independently of the rotation of the photosensitive drum (the relative rotation includes the rotation at a different velocity and in the same direction or the rotation at the same or different velocity and in a different direction) or to fix the grooved rotatable member to the stationary shaft 14 so as to be independent of the rotation of the photosensitive drum. As shown in FIGS. 1 and 4, the toner delivered by the screw roller 12 (FIG. 3) within the cleaning container is forced to change its course by a wall 24 and directed into a groove in the rotatable member 10 by such means as a multivane member or brush 25. The photosensitive drum 22 and grooved rotatable member 10 rotating together serve to provide smooth conveyance and delivery of the toner and to prevent scattering or leakage of the toner, and thus the toner may be carried into the developing means 2 by the grooved rotatable member 10 serving as a conveyor. The photosensitive drum 22 may be detachably mounted, if required, and the developer conveyor system may preferably be located at a rear position which would offer no interference with the mounting and dismounting of the photosensitive drum. Of course, the grooved rotatable conveyor member 10 may preferably have an outer diameter substantially equal to or less than that of the photosensitive drum 22, and more effective prevention of the toner scattering may be ensured by a plate-like band 13 fixedly secured to the outer periphery of the rotatable member 10, if such band is tightened into contact with that periphery. Although not shown, felt or other seal material may be added to the band 13 to eliminate the need to tighten the band, or a rigid member may also be used to achieve the purpose. If a space available for the conveyance is thus provided in the cross-section, the toner which would otherwise tend to be forced outwardly of the vanes may safely be directed into the developing means 2 by the rotatable member 10. If it is desired to reduce the abrasion or friction between the rotatable member and the band, the band may be formed of Mylar, silicone rubber or metal plate coated with Teflon.

The path of rotational movement of the rotatable groove so formed lies outwardly of the photosensitive drum shaft 14 and inside the charger means 4, 5 disposed around the photosensitive medium 22 and also lies beyond the effective width of the photosensitive medium, so that the groove can guide the collected toner from the cleaning means into the developing means 2 without interfering with any of these copying process means.

In such construction, a scraper 26 formed of Mylar, urethane rubber or like material may be brought into contact with the toner conveying surface of the rotatable groove to thereby ensure the toner in the groove to be guided in the intended direction and readily directed to the inlet port of the developing means 2 without scattering or falling to undesirable places.

After supplying the developing means 2 with the toner, the groove continues to rotate to return to the cleaning means, thus effecting continuous conveyance of the toner. Although not shown, means for preventing toner scattering similar to the band 13 may additionally be provided over the range from the developing means through the image transfer means 6 to the cleaning means 1 in order to effectively prevent contamination of the interior of the machine.

Figure 5:
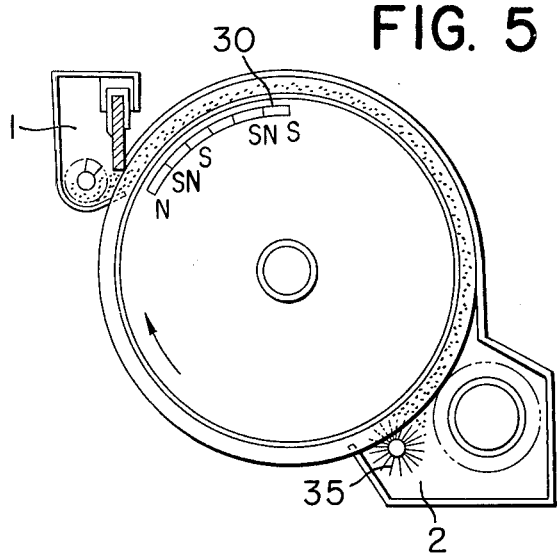
FIG. 5 is a vertical cross-section of another embodiment of the present invention.
Figure 8:
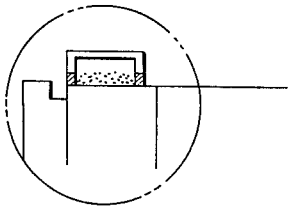

In this manner, the collected developer may be conveyed along the other peripheral surface of the rotatable conveyor member without being subjected to any extraneous force, so that the collected developer may mix with the developer within the developing means while keeping itself ready for development without producing coagulation between the toner particles. It will be apparent that the cross-section of the groove in the rotatable conveyor member 10 may be rectangular, V -or U-shaped or any other shape as required. As shown in FIG. 8, it may also be flattened with a rectangular channelshaped guide provided outwardly thereof, to obtain just the same effect as described above.

Where it is required to have the cleaning means 1 disposed at a lower level as shown in FIG. 5, a sheet of magnetic material or magnetic rubber 30 may effectively be added to the inner side wall of the rotatable conveyor member so that magnetic toner particles or toner particles including magnetic carrier may positively move up while rotating and revolving, thus finally passing into the developing means 2. Employment of such system can greatly enhance the dispersion effect without the possibility of coagulation occurring between the toner particles, and this also leads to an advantage that supplemental toner can be supplied midway of the conveying path.

Figure 6:
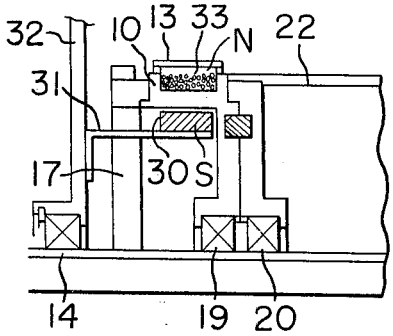
FIGS. 6 to 8 are fragmentary enlarged views showing various forms of the secondary conveyor means in the second embodiment.

FIG. 6 is a longitudinal section corresponding to FIG. 5. The grooved rotatable member 10 is formed of a nonmagnetic material and a magnetic material 30 is securely held by a holder plate 31 fixed to a frame 32. The magnetic line of force passed through the nonmagnetic material 10 has its effect on the conveying space 33 so that toner particles stick to and rotate on the outer peripheral surface of the rotating member 10, thus being positively conveyed as if conveyed through a sleeve conveyor. Further, the conveying outer peripheral surface of the rotatable conveyor member 10 may be knurled or sand-like so that the surface ruggedness may ensure more stable conveyance. If required, the toner particles may be completely collected into the developing means 2 as by a brush 36.

Figure 7:
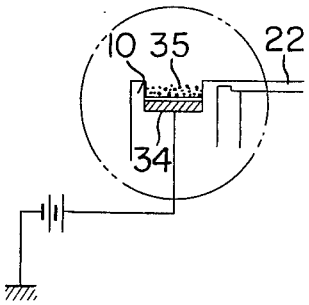

FIG. 7 shows an application of electrostatic power for the conveyance of magnetic toner or toner including carrier. The rotatable conveyor member 10 is formed of an insulative material, and an electrode 34 of conductive material is disposed around the rotatable member 10 and covered with an insulative material 35 similar to the rotatable member, and the electrode 34 may be connected to, for example, a power source for biasing. Such arrangement is highly effective for the conveyance of toner. Although not shown, the outer peripheral surface of the rotatable member may be corona-charged to effect the toner conveyance likewise and thus, it becomes possible to convey toner particles by using a copy corona charger to charge a band-like sheet attached to the photosensitive medium used for copying. Again in this case, there is provided the same effect as described for the system of FIGS. 6 and 7, and the scatter preventing guide or band is not always required along the conveying path.

While all of the foregoing embodiments have been described with respect to the case where the collected toner is guided into the developing means, it is also possible to guide the collected developer into developer supply means, for example, a hopper, for reuse. This is particularly effective to prevent any change in the mixture ratio of carrier to toner in the developer within the developing means.

In all of the above-described embodiments, the shaft of the rotatable conveyor member has been common to the rotatable support shaft of the photosensitive drum, whereas this is not the only possible form but, if required, a plurality of rotatable shafts may be employed to provide a belt conveyor arrangement. Alternatively, the rotatable conveyor member may be formed outside the rotating portion and a stationary leakage member may be provided inside such portion.

As detailed above, according to the present invention, the developer which has been removed from the surface of the photosensitive medium, is conveyed by the first conveyor means to the developer conveyor member (having a peripheral surface which is flush with or lower than the surface of the photosensitive medium) and is further conveyed by the second conveyor means to the developer containing portion, whereby the developer is repetitively used during operation of the copier. Thus, the present invention makes the copying machines service-free and eliminates any special collector means for the developer. Also, it makes no interference with the desired replacement of the photosensitive medium and permits reuse of the toner which will ensure high quality image reproduction.

Further, a common drive source may be used to drive the drive means for the photosensitive drum and the drive means for the conveyor member and this leads to a simple construction and reduced cost.

We claim:

1. A developer conveyor device comprising:
a rotatable photosensitive medium repetitively used;
a developer conveyor member disposed outwardly of the effective width of the photosensitive medium, said developer conveyor member having a peripheral surface which is flush with or lower than the surface of said photosensitive medium to convey the developer to a developer containing portion;
cleaning means for removing unnecessary developer on the surface of said photosensitive medium;
means for transporting, to said developer conveyor member, the developer removed by said cleaning means.

2. A developer conveyor device according to claim 1, wherein said developer conveyor member is a member rotatable with said rotatable photosensitive medium.

3. A developer conveyor device accirding to claim 2, wherein said developer conveyor member comprises a rotatable member having a magnet disposed therewithin.

4. A developer conveyor device accirding to claim 3, wherein said magnet has opposite polarities alternately arranged along the direction of rotation of said rotatable member.

5. A developer conveyor device according to claim 1, wherein the peripheral surface of said developer conveyor member has a high friction coefficient.

6. A developer conveyor device according to claim 1, wherein means for electrostatically attracting the developer is provided on the peripheral surface of said developer conveyor member.

7. A developer conveyor device according to claim 1, wherein said developer containing portion is a developing device.

8. A developer conveyor device according to claim 1, wherein said developer containing portion is a developer supplying device.

9. A developer conveyor device according to claim 1, wherein said developer conveyor member is stationary.

10. A developer conveyor device according to claim 1, wherein said developer conveyor member has a groove formed in the peripheral surface thereof.

11. A developer conveyor device according to claim 10, wherein said developer conveyor member has said groove covered with a cover.

12. A developer conveyor device according to claim 1, wherein said developer conveyor member has its peripheral surface formed with no groove and covered with a cover member.

13. A developer conveyor device according to claim 1, wherein said cleaning means comprises a blade.

14. A developer conveyor device according to claim 1, wherein said developer conveyor member is a member rotatable separately from said photosensitive medium at a relatively different velocity.

15. A developer conveyor device according to claim 1, wherein said means for transporting the developer comprises a screw roller.

16. A developer conveyor device according to claim 15, wherein said screw roller is elastic.

17. A developer conveyor device according to claim 15, wherein said screw roller is rigid.

18. A developer conveyor device comprising:
a rotatable photosensitive medium repetitively used;

a developer conveyor member disposed outwardly of the effective width of the photosensitive medium;

said developer conveyor member being a member having its peripheral surface flush with or at a lower level than that of said rotatable photosensitive medium;

cleaning means for removing unnecessary developer on the surface of said photosensitive medium;

means for transporting the unnecessary developer removed by said cleaning means to said developer conveyor member by moving it in a direction perpendicular to the direction of the movement of said photosensitive member; and means for guiding the unnecessary developer from said developer conveyor member to a developer container.

19. A developer conveyor device according to claim 18, wherein said means for guiding the unnecessary developer from said developer conveyor member to a developer container comprises a blade bearing against the peripheral surface of said developer conveyor member.

20. A developer conveyor device according to claim 18, wherein said means for guiding the unnecessary developer from said developer conveyor member to a developer container comprises a rotatable brush bearing against the peripheral surface of said developer conveyor member.

* * * * *

UNITED STATES PATENT OFFICE

CERTIFICATE OF CORRECTION

Patent No. 3,951,542 Dated April 20, 1976

Inventor(s) YOSHIO ITO, TORU TAKAHASHI, TADAYUKI KITAJIMA, AND SYUJIRO KADAWAKI

It is certified that error appears in the above-identified patent and that said Letters Patent are hereby corrected as shown below:

Column 6

Claim 3, line 1, delete "accirding" and insert --according--.

Claim 4, line 1, delete "accirding" and insert --according--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*